United States Patent [19]

Kunert et al.

[11] Patent Number: 4,721,845

[45] Date of Patent: Jan. 26, 1988

[54] ELECTRICALLY HEATABLE VEHICLE GLASS PANE

[75] Inventors: Heinz Kunert, Cologne; Gerd Sauer, Stolberg-Venegen; Hans Ohlenforst, Aachen, all of Fed. Rep. of Germany

[73] Assignee: Saint-Gobain Vitrage, Courvevoie, France

[21] Appl. No.: 905,459

[22] Filed: Sep. 10, 1986

[30] Foreign Application Priority Data

Sep. 10, 1985 [DE] Fed. Rep. of Germany ..... 3532119

[51] Int. Cl.[4] ..... H05B 1/00

[52] U.S. Cl. ..... 219/203; 219/541; 219/543; 219/547; 338/307; 338/322

[58] Field of Search ..... 219/522, 203, 541, 543, 219/547, 202, 279; 338/307-309, 322, 35; 428/192, 209, 210

[56] References Cited

U.S. PATENT DOCUMENTS

| | | | |
|---|---|---|---|
| 3,467,818 | 9/1969 | Ballentine | 219/203 |
| 4,284,677 | 8/1981 | Herliczek | 219/203 |
| 4,361,751 | 11/1982 | Criss et al. | 219/203 |
| 4,388,522 | 6/1983 | Boaz | 219/522 |
| 4,443,691 | 4/1984 | Sauer | 219/203 |
| 4,488,033 | 12/1984 | Trachtenberg | 219/203 |
| 4,618,088 | 10/1986 | Karla | 219/203 |

*Primary Examiner*—M. H. Paschall

*Attorney, Agent, or Firm*—Oblon, Fisher, Spivak, McClelland & Maier

[57] ABSTRACT

In an electrically heatable automobile glass pane with heating conductors printed onto and baked into a surface, which conductors are connected to printed-on and baked-in collecting conductors, metal strips are disposed on the baked-in collecting conductors and are electrically connected with these collecting conductors. The baked-in collecting conductors and the metal strips connected with them are furnished with a plastic coating which jointly covers them and is glued to them and to the glass surface.

16 Claims, 3 Drawing Figures

ELECTRICALLY HEATABLE VEHICLE GLASS PANE

BACKGROUND OF THE INVENTION

1. Field of the Invention

This invention relates to an elecrically heatable automobile glass pane with printed-on and baked-in, thin heating conductors disposed on one surface, which conductors are connected with collecting conductors, disposed along the edge of the glass pane and printed-on and baked-in simultaneously with the heating conductors, metal strips being disposed on the printed-on and baked-in collecting conductors and being electrically conductingly connected with them.

2. Description of the Related Art

Electrically heatable automobile glass panes are used especially as rear window panes in automobiles. If the collecting conductors, which serve for electrical supply to the heating conductors, consist only of the printed-on and baked-in conducting material of which the heating conductors consist, they must be made relatively wide in order that their electrical resistance shall not become too high, since otherwise they become too hot. However, even if made relatively wide, their electrical resistance is still high on account of the extraoridinarily small thickness of the printed-on and baked-in coating. Even with a relatively wide construction, it is usually not possible to avoid a portion of the electrical energy becoming lost due to the undesired heating-up of the collecting conductors.

For avoiding this disadvantage, it is known to reduce the electrical resistance of the printed-on and baked-in collecting conductors by the provision of a metallic conductor, for example a strip of copper sheet or a flat strand of copper (U.S. Pat. No. 3,467,818). The metal strip is here soldered, for example at intervals, to the baked-in collecting conductor. In order to prevent harmful mechanical stresses from occuring due to the different coefficients of thermal expansion of the metal strip and of the glass pane, which could lead to fracture of the soldering points, the metal strip is convex curved in the manner of a bridge span in the regions between the solder points. The printed-on and baked-in collecting conductors can be of relatively thin construction in this known heated pane.

Heated panes with such reinforcing strips soldered onto the collecting conductors in turn have other disadvantages. Firstly, the metal strips projecting on the surface represent a nuisance in packaging and handling the glass panes, and it can easily happen that if the soldered-on metal strps are bumped or knocked, they bend or the solder points become loosened. Furthermore, such collecting conductors reinforced by metal strips are especially disadvantageous when the collecting conductors are disposed not at the outermost edge of the glass pane, but at a distance from the pane edge and within the viewing field, which is inevitably the case when the heating conductors are used also as radio antenna conductors. In this case, the collecting conductors must be disposed at a distance of a few centimeters from the frame of the bodywork, because otherwise the capacitance of the antenna conductors adopts unacceptably high values. In such a conductor network, serving both as antenna and as heating resistor, there are advantages in constructing the collecting conductors, which are situated entirely in the viewing field, to be as narrow as possible, which can best be achieved by reinforcing them with an additional metal strip. On the other hand, the provision of an additional metal strip is a nuisance, because the metal strip is not only an obstruction, for example when cleaning the glass pane, but because in particular there is a risk that the additional metal strip, when the glass pane is cleaned or in other circumstances, may be so heavily stressed that the connection points with the baked-on coating of the collecting conductor become loosened.

SUMMARY OF THE INVENTION

The object of the present invention is to construct a heated pane of the type described in which the risk of damage to the additional metal strips and destruction of the connection points between the metal strips and the baked-in collecting conductors is reliably avoided.

According to the invention, this task is achieved in that the baked-in collecting conductors and the metal strips electrically conductingly connected therewith are furnished with a plastic coating, covering them jointly and glued to them and to the glass surface.

The metal reinforcing strip of a combined collecting conductor is, therefore, according to the invention completely embedded in a plastic material which, for its part, firmly and permanently adheres to the baked-in layer of the collecting conductor and to the glass surface immediately adjacent to the baked-in conductor layer. From this, some substantial advantages result: firstly, the metal strip is reliably protected against mechanical loading, so that the risk of the breaking away at the connection points to the baked-in collecting conductor layer is completely eliminated. At the same time, by the embedding in the plastic material, the risk of possible sharp edges of the metal strip injuring the hand, for example when the glass pane is cleaned, is completely prevented. Furthermore, the optical impression of the combined collecting conductor is considerably improved by the coating, which usually consists of opaque plastic material. Morever, an additional mechanical fixing of the metal strip onto the baked-in collecting conductor layer is obtained by the bonded coating. Consequently, the electrically conducting connection with the collecting conductor layer can be carried out in a manner which fully provides for a good electrically conducting connection, without at the same time needing to have great mechanical strength. As a result, those electrically conducting connections can be used which themselves possess inadequate mechanical strength, because the connection points undergo considerable mechanical stabilization and strengthening by the sheathing of the collecting conductors with the hardened plastic material. It is therefore possible, with a heated pane according to this invention, to make use of economical contacting methods, without needing to take account of the mechanical strength of the electrically conducting connection. The connection points also do not need to have particular resistance against chemical attack, for example by moisture, because they are ideally protected by the complete sheathing against such influence.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
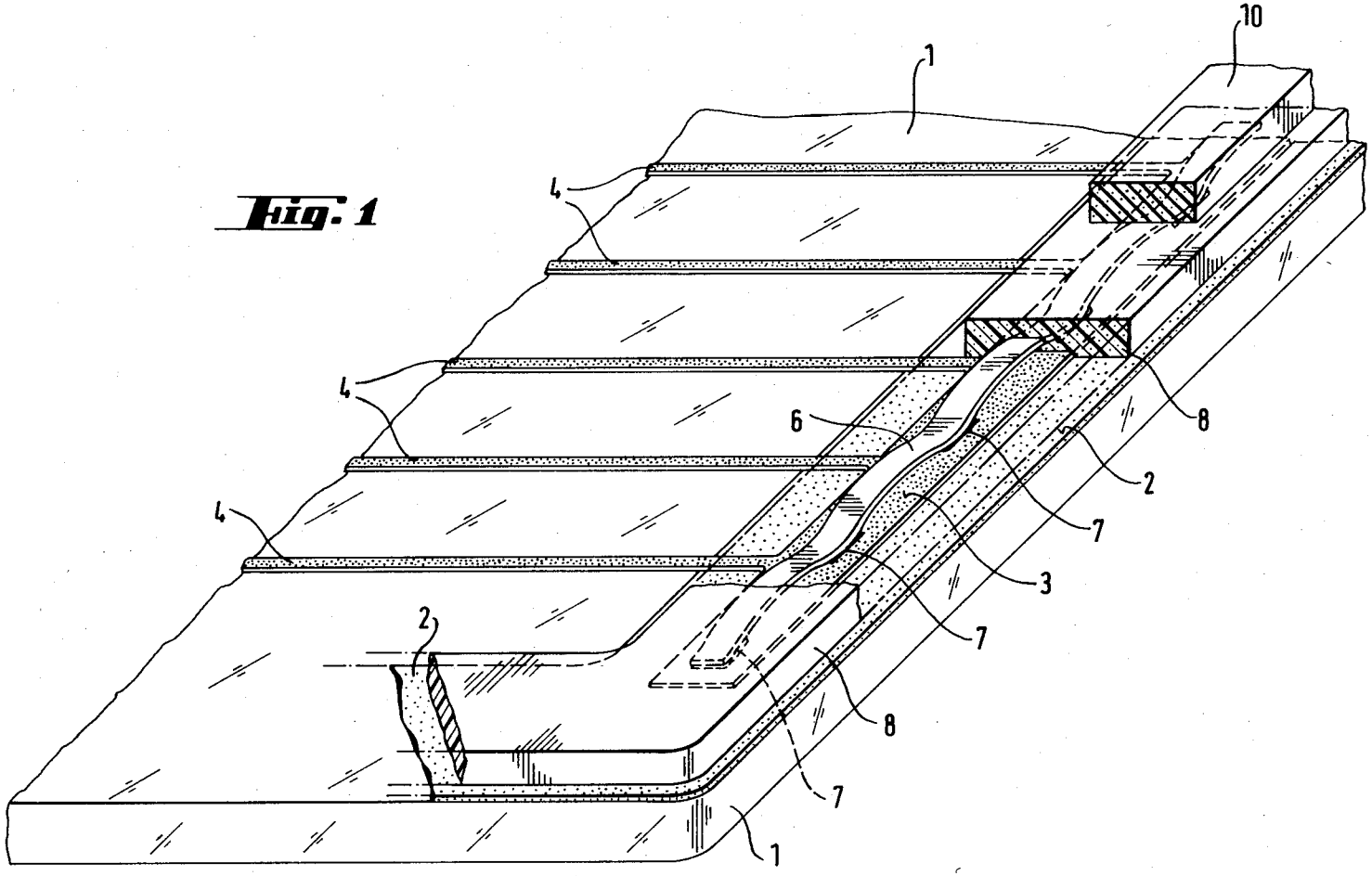
FIG. 1 is a perspective view of a first embodiment of a heated pane according to this invention with a collecting conductor disposed immediately at the edge of the glass pane.

The heated pane illustrated in FIG. 1 relates to a heatable rear pane for an automobile, which as such is connected by the method of direct bonding to the fixing flange of the bodywork. The silicate glass pane 1 is furnished, along one face of its pane periphery, with a frameshaped layer 2, usually some centimeters wide, of an opaque coating, especially of a ceramic baked finish. This one face over which the frame shaped layer is applied is an outer face. That is, it is not an internal face of a glass laminate which is otherwise covered by another glass pane. Collecting conductors 3 are disposed on this baked-in finish from which the heating conductors 4 extend over the viewing region of the glass pane. The collecting conductors 3 and the heating conductors 4 are of an electrically conducting baked finish and are applied by known methods in one and the same operation by means of screen printing onto the glass surface and the already applied layer 2 respectively, and are baked-in during the heating necessary for the bending and/or toughening processing of the glass pane.

The collecting conductors 3 are of relatively narrow construction. On the collecting conductor 3, a metal strip 6 is disposed, preferably over the entire length of the conductor 3. The metal strip 6 may, for example, be a strip of copper sheet. The metal strip may instead be a flat wire strand of copper or tinned copper. In the example illustrated, the metal strip 6 is applied in a slightly undulating form. At intervals, the metal strip 6 touches the baked-in collecting conductor 3. At these contact points, the metal strip is connected with the baked-in collecting conductor 3 by means of a suitable connecting means 7. The connecting means may, for example, be a solder as hitherto commonly used. It is suitable, however, for the connection to be made by a more economical method instead of by soldering. Suitable for this purpose, for example, is the already known bonding process in which the electrically conducting connection is produced as a welded connection by punctiform ultrasonic application. It is also possible to use, as connecting means, thermoplastic or thermosetting electrically conducting plastic adhesives.

On the frame-like layer 2, a layer 8 of a hardenable plastic is firmly and sealingly bonding to the entirety of the layer 2, the collecting conductor 3 and the metal strip 6. The application of this plastic layer 8 is advantageously carried out by means of a suitably calibrated extruder nozzle, which is automatically conducted along the glass pane by means of a suitable apparatus. The adhesive material thus deposited on the layer 2, the collecting conductor 3 and the metal strip 6 encases the metal strip 6 and, after it has hardened, is firmly and permanently bonded onto the layer 2, the collecting conductor 3 and the metal strip 6.

Suitable materials for the plastic layer 8 are, for example, adhesive materials such as are commonly used for gluing the glass pane to the automobile bodywork. A common adhesive composition, which is also suitable for the present purpose is, for example, a moisture-hardening, single-component polyurethane adhesive, as described in U.S. Pat. No. 3,779,794. The surfaces onto which the adhesive is applied may, if necessary, be pretreated in known manner with suitable cleaning means and/or with suitable primer compositions.

The applicaton of the plastic layer 8 onto the edge region of the glass pane is favorably carried out in the fabrication location for the heated pane. In this manner, the advantages which the invention offers can be fully utilized. As soon as the plastic layer 8 has hardened, the heated pane is ready for packing and dispatched to the automobile factory.

For the purpose of installing the glass pane into the window frame of the bodywork, an adhesive strand 10 necessary for the bonding, and comprising an adhesive compatible with the plastic layer 8, is deposited with the help of an extruder nozzle on the plastic layer 8 and the glass pane is set in the window opening. The adhesive strand 10 can, of course, be applied onto the fixing flange in the window frame of the bodywork, instead of onto the glass pane. A roughening of the surface of the hardened plastic layer 8 may be advantageous before the layer 8 is brought into contact with the adhesive strand 10.

Figure 2:
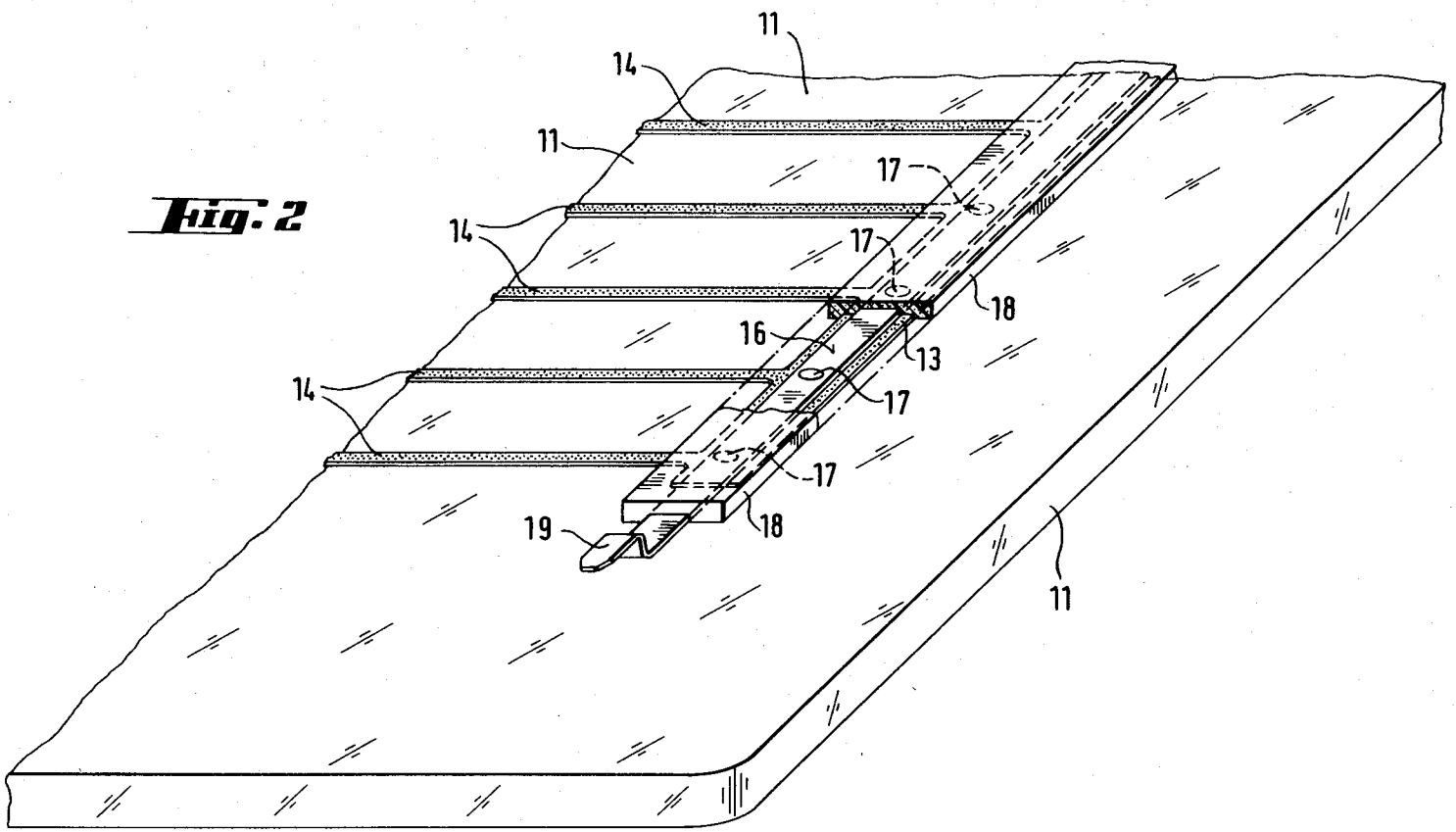
FIG. 2 is a perspective view of another embodiment of a heated pane according to this invention with collecting conductors which are located at a distance from the edge of the pane and within the viewing field of the glass pane.

The embodiment illustrated in FIG. 2 shows a heatable automobile glass pane without a surrounding, frame-like facing, which is intended for installation by means of a bordering frame of rubber. The glass pane 11 here again is furnished on one surface with printed-on and baked-in collecting conductors 13 and heating conductors 14. The collecting conductors 13 are disposed at a distance of several centimeters from, and parallel to, the edge of the pane, so that in the installed state of the pane they are at a distance of at least 2 to 3 centimeters from the metal parts of the window frame. Such a distance of the collecting conductors from the metal frame is necessary if the conductors 13, 14 are to be used not only for heating the glass pane but also as antenna conductors, because otherwise the capacitance of the antenna conductors would adopt too high a value.

A narrow metal strip 16, for example a copper sheet, is disposed on the printed-on and baked-in collecting conductors 13. This metal strip 16 extends over the entire length of the collecting conductor 13 and is connected locally at connection points 17 to the baked-in collecting conductors 13. The connection points 17 may favorably be disposed at positions corresponding to the intersection of the conductors 13 with the individual heating conductors 14. In this manner, the metal strip 16 basically has the function of covering over and protecting the collecting conductors 13 from the outside. The collecting conductors 13 can, in this way, be made extremely narrow.

The electrically conducting connections 17 can, in turn, be made by means of a suitable process, for example, soldering, gluing or by the known bonding process, using ultrasonic energy. The metal strip 16 is offset at one end and shaped to a flat plug 19, with which, in the installed state of the heated pane, the electricity supply cable is connected via an appropriate coupling plug.

The baked-in collecting conductor 13 and the metal strip 16 electrically conductingly connected therewith, are in turn covered by a plastic layer 18 applied in the form of a strip. This plastic layer 18 consists, as in the previous example, of an extrudable adhesive material, which firmly and permanently bonds to the glass surface, collecting conductor 13 and the metal strip 16. It is applied onto the collecting conductors by a suitable process, for example by means of an appropriately calibrated extruder nozzle and by the use of an automatically operating apparatus for guiding this nozzle. After the adhesive material has hardened, the layer 18 provides an ideal protection for the collecting conductors.

Figure 3:
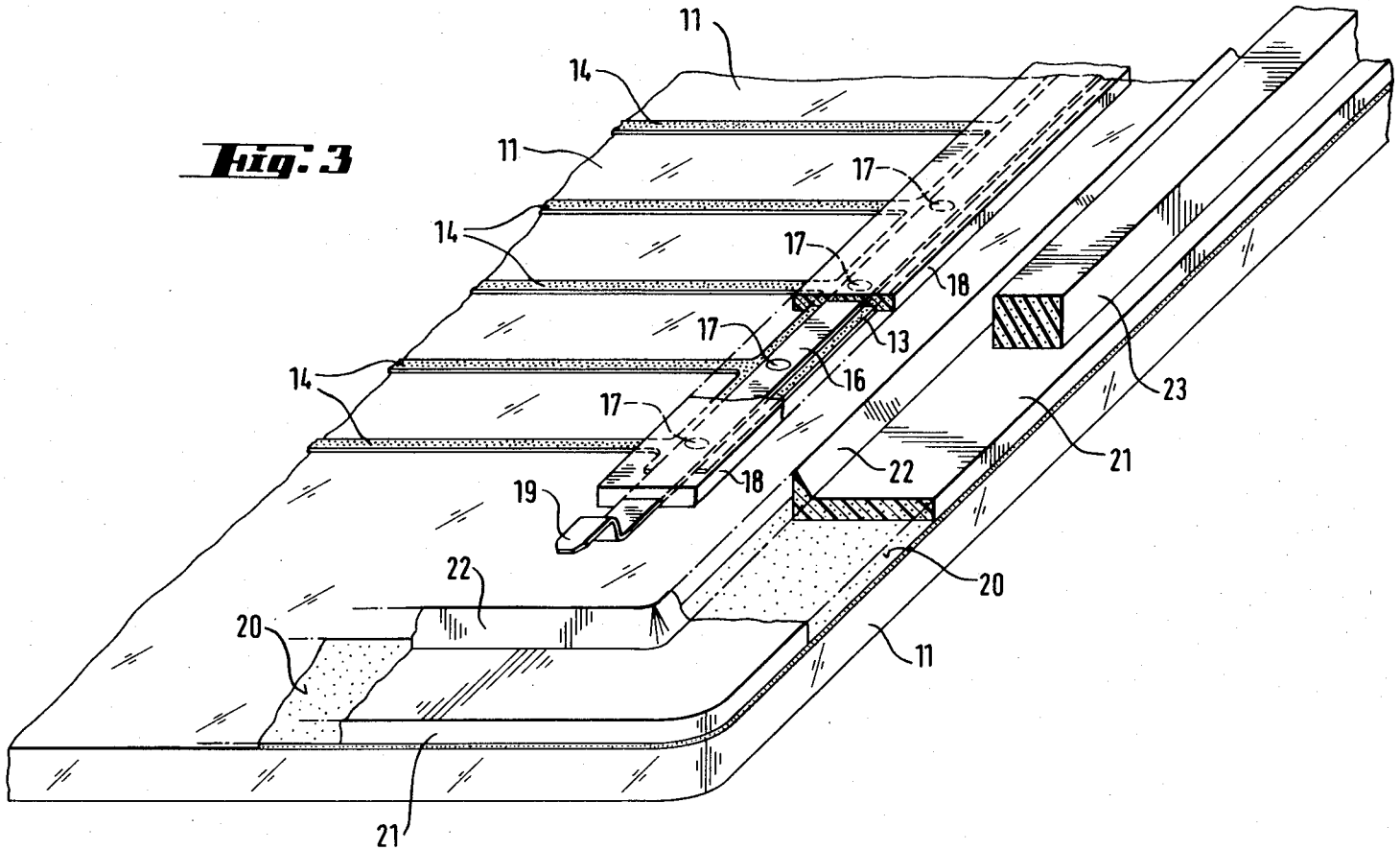
FIG. 3 is a perspective view of embodiment of a heated pane of this invention, in which the conductor network can also be used as an antenna conductor network.

The electrically heatable glass pane illustrated in FIG. 3 has the same construction and the same form as the heatable glass pane shown in FIG. 2, in respect of the collecting conductors 13 and heating conductors 14, printed-on and baked-in to the glass pane 11, and of the metal strips 16 reinforcing the collecting conductors 13, the connection points 17, the plastic coating 18 covering the collecting conductors, and the flat plug or spade terminal 19. It is, however, in this case prepared for direct bonding into the frame in the bodywork. For this purpose, an opaque, frame-like facing 20, usual in such cases, is provided on the edge region. This frame-like facing 20 may be of any lacquer suitable for this purpose or a baked finish. Onto this facing 20, a hardened, flat-profiled adhesive layer 21 is disposed all around. This hardened adhesive layer is also applied with an appropriately calibrated extruder nozzle conducted along the edge of the pane. The profiled adhesive layer is equipped, on the side towards the viewing area of the glass pane, with a lip 22 which is wedge-shaped in section. This lip 22 acts, when the glass pane is installed into the window frame, as a boundary strip for the adhesive material, which is applied in the form of an extruded strand 23 onto the hardened adhesive layer 21 or onto the fixing flange of the window frame in the bodywork. When the glass pane is fitted to the frame of the vehicle, the lip 22 prevents the soft adhesive material from being squeezed out towards the viewing area of the pane. This measure not only has an aesthetic function but is also important for technical reasons, if the electrical conductors are to be used as antenna conductors. Since the usual adhesive materials have a certain electrical conductivity, an escape of the adhesive material of the strand 23 can, in certain circumstances, lead to a short-circuit between bodywork and antenna conductors, particularly if the plastic layer 18 also possesses a certain electrical conductivity. Such a short-circuit would cause the electrical conductors on the glass pane no longer to fulfil their function as an antenna.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An electrically heatable glass pane comprising:

a glass pane member;

printed-on and baked-in thin heating electrical conductors disposed on one face of said pane member;

printed-on and baked-in collecting electrical conductors disposed on said one face and connected with said heating conductors;

metal strips disposed on, and electrically conductingly connected with, said collecting conductors; and a plastic coating covering said collecting conductors and metal strips and bonded to said collecting conductors, metal strips and glass pane, wherein said plastic coating comprising a hardenable adhesive material applied on said collecting conductors and metal strips, and hardened in place.

2. The pane of claim 1, wherein said metal strips comprise strips of metal sheet.

3. The pane of claim 1, wherein said metal strips comprise flat wire strands.

4. The pane of claim 1, including soldered connections between said metal strips and said collecting conductors.

5. The pane of claim 1, including ultrasonic welded connections between said metal strips and said collecting conductors.

6. The pane of claim 1, electrically conductive adhesive connections between said metal strips and said collecting conductors.

7. The pane of claim 1, including an opaque frame-like facing adjacent edges of said one face of said pane member, wherein said collecting conductors and said plastic coating are formed on said facing.

8. The pane of claim 7, including an adhesive strand applied to said plastic coating for adhering said pane to a vehicle frame.

9. The pane of claim 1, wherein said collecting conductors, said metal strip and said plastic coating are disposed at a distance from edges of said pane and within viewing area thereof.

10. The pane of claim 9, including an opaque frame-like facing adjacent edges of said one face of said pane member, wherein said collecting conductors and said plastic coating are formed on said facing.

11. The pane of claim 10, including a flat hardened adhesive coating disposed on said facing.

12. The pane of claim 11, wherein an edge of said flat adhesive coating opposite said pane edge includes lip means for retaining adhesive material when said pane is set into a vehicle frame.

13. The pane of claim 1, wherein said plastic coating comprises a moisture hardenable, single component polyurethane adhesive.

14. The pane of claim 1, wherein said plastic coating comprises a two component reaction adhesive.

15. The pane of claim 1 wherein said plastic coating covers less than the entirely of said one face.

16. The pane of claim 1 wherein said one face is an outer face of said glass pane.

* * * * *